US005378270A

United States Patent [19]

Takashima

[11] Patent Number: 5,378,270

[45] Date of Patent: Jan. 3, 1995

[54] MOLD RELEASE MATERIAL FOR DIE CASTINGS

[75] Inventor: Masaru Takashima, Tokyo, Japan

[73] Assignee: Aikoh Co., Ltd., Japan

[21] Appl. No.: 989,014

[22] PCT Filed: Oct. 26, 1990

[86] PCT No.: PCT/JP90/01385

§ 371 Date: Sep. 16, 1993

§ 102(e) Date: Sep. 16, 1993

[87] PCT Pub. No.: WO92/07673

PCT Pub. Date: May 14, 1992

[51] Int. Cl.[6] ..... B28B 7/38; B28B 7/36

[52] U.S. Cl. ..... 106/38.22; 106/38.24; 106/38.25; 106/243; 106/244

[58] Field of Search ..... 106/38.2, 38.22, 38.24, 106/38.25, 243, 244, 2

[56] References Cited

U.S. PATENT DOCUMENTS

| | | | |
|---|---|---|---|
| 3,034,186 | 5/1962 | Holshouser | 106/38.24 |
| 4,609,570 | 9/1986 | Couleau et al. | 106/38.24 |
| 4,634,469 | 1/1987 | Laemmle et al. | 106/38.24 |
| 5,169,891 | 12/1992 | Brown | 524/284 |

FOREIGN PATENT DOCUMENTS

| | | | |
|---|---|---|---|
| 611431 | 12/1960 | Canada | 106/38.24 |
| 60-137540 | 7/1985 | Japan . | |
| 62-168635 | 7/1987 | Japan . | |
| 3210372 | 9/1991 | Japan | 106/38.24 |

*Primary Examiner*—Anthony Green
*Attorney, Agent, or Firm*—Larson and Taylor

[57] ABSTRACT

The mold release material for die castings is such one that an emulsion based on animal or vegetable oils, mineral oil, fatty acid and esters thereof is added an alkali metal or alkali earth metal salt of EDTA in the range 10–10,000 ppm. The alkali metal or alkali earth metal salt of EDTA prevents the aqueous solution of emulsion of the mold release material of the invention from micell formation, forms a stable emulsion, is scarcely affected by temperature, and forms bivalent metal ion and water soluble complex whereby it does not form deposits even if hard water is used as diluted water of the mold release material.

2 Claims, No Drawings

MOLD RELEASE MATERIAL FOR DIE CASTINGS

INDUSTRIAL FIELD OF THE INVENTION

This invention relates to an improvement in a mold release material for die castings.

PRIOR ART

Known mold release materials for die castings are ones based on animal and vegetable oils or mineral oil and to which base material is added fatty acid, paraffin wax, silicone oil, graphite and the like to give heat resistance. However, it is known that though such additives may present a mold release material of high heat resistance, adding only fatty acid or paraffin wax causes an increase of viscosity of the mold release material emulsion or causes difficulties in automatic spraying of the material. Adding silicone oil or graphite either causes defects in the product such as crimp or blow holes as a result of the residual solids remaining in the die casting mold or pollutes the mold.

On the other hand, mold release materials for die castings, which are added with solids, are also commercially available. However, where they are used by automatic spraying under a centralized piping feed system, they cause clogging of the nozzle of the automatic spray and working difficulties.

The mold release material of the present invention does not use additives such as silicone oil and graphite which generate residual solids in the die casting mold, and its bases comprise only one or more of animal and vegetable oils, mineral oil, fatty acid and esters thereof. As a result, it does not cause pollution of the die casting mold by silicone oil or graphite, E contamination of the working environment by graphite, or any other public nuisance since the waste water can be easily disposed.

However, water-soluble emulsions constituted only of fats and fatty oil have drawbacks in that the viscosity of the aqueous solution greatly varies. There is a large increase in viscosity as the temperature of the solutions rises, and in an extreme case, the aqueous solution gelatinizes.

DISCLOSURE OF THE INVENTION

To achieve the above objects, in the mold release material of the invention to an emulsion based on one or more of animal and vegetable oils, mineral oil, fatty acid and ester thereof is added an alkali metal or alkaline earth metal salt of ethylenediaminetetraacetic acid (hereinafter referred to as alkali metal or alkaline earth metal salt of EDTA).

The inventor of this invention has conducted extensive research in an attempt to produce and provide a new mold release material for die castings, and as a result he has found that an alkali metal or alkaline earth metal salt of EDTA prevents the aqueous solution of emulsions of these mold release materials from micell formation, forms a stable emulsion that is hardly affected by temperature, and even enables use of hard water as the diluted water of the mold release material to form bivalent metal ion and water soluble complexes that do not form deposits.

BEST EMBODIMENTS TO CARRY OUT THE INVENTION

As described above, the mold release materials for die castings relating to this invention form a stable emulsion by adding to the components of the material an alkali metal or alkaline earth metal salt of EDTA in the range of 10–10,000 ppm. Further, it is confirmed that the addition of alkali metal or alkaline earth metal salt of EDTA does not adversely affect the mold release effect of the material for die castings. To describe the effect of the invention more definitely, an Example for molding a die casting of an aluminum alloy is mentioned below.

If the alkali metal or alkaline earth metal salt of EDTA is added at less than 10 ppm, the effect of the additive is not noticed. If more than 10,000 ppm of the additive is added, an improvement in the effect is not confirmed either.

Below is mentioned an Example of the invention, which uses EDTA-4Na, a representative example of an alkali metal or alkaline earth metal salt of EDTA.

EXAMPLE

The following composition was obtained as a mix of the mold release material for die castings according to the invention.

| | |
|---|---|
| Fatty acid quaternary ammonium salt | 18% |
| Hydrocarbon | 22% |
| Polyoxyethylene alkyl ether | 30% |
| Fatty acid glycerol ester | 10% |
| Water | 28% |

The above mix was diluted threefold and 300 ppm of EDTA-4Na was added, and the change in viscosity was measured in comparison with products to which the additive was not added. The values of the viscosity change are shown in Table 1.

TABLE 1

| Temperature (°C.) | Viscosity change (cp) by EDTA-4Na | | | | | | |
|---|---|---|---|---|---|---|---|
| | 5 | 10 | 20 | 30 | 40 | 50 | 60 |
| Not added | 240 | 250 | 300 | 500 | 1,200 | 6,000 | 70,000 |
| Added by 300 ppm | 65 | 45 | 30 | 30 | 30 | 30 | 30 |

Further, the above mix was diluted by 2.5 times and the additive amount of EDTA-4Na was changed to measure the change of the viscosity. The values in the viscosity change are shown in Table 2.

TABLE 2

| Additive amount (ppm) of EDTA-4Na | 0 | 10 | 300 | 1,000 | 10,000 |
|---|---|---|---|---|---|
| Viscosity (cp) | 7,540 | 3,800 | 428 | 200 | 47 |

The above mix was diluted threefold and 300 ppm of EDTA-4Na was added to prepare a specimen. When used the specimen was diluted by 80 times, and an injection molding was effected using an aluminum alloy (JIS: ADS-12).

Machine used: 350t die casting machine
Material: ADC-12
Melt temperature: 680° C.
Product: Transmission oil seal for motor vehicles

| | Product of this invention | Commercially available article |
|---|---|---|
| Shot frequency until the mold is required for polishing | 3,500 | 1,800 |

-continued

| | Product of this invention | Commercially available article |
|---|---|---|
| Surface of product | Excellent | Good |
| Raton (%) of inferior quality products | 1 | 2 |

As described above in detail, the present invention provides the emulsion of mold release material for die castings with excellent stability, is constituted of a substance that deposits residue to the die casting mold, and, therefore, provides excellent working properties.

Use of other alkali metals or alkaline earth metal salts of EDTA give almost the same results.

Moreover, by changing the kind of animal or vegetable oil used, it is also possible to control the amount of residual carbon of the mold release material for die castings, and it has an advantage of flexibly coping even with the dimension of the die casting machine.

INDUSTRIAL APPLICATION EASIBILITY

Though the mold release material of the present invention has been described with regard to the die castings of an aluminum alloy, it can achieve the same functional effect even when used as the mold release material for die castings of aluminum, magnesium or alloys thereof, and zinc and alloys thereof.

I claim:

1. A mold release material for die castings comprising an emulsion of at least one of selected from the group consisting of mineral oil and fatty acid and esters thereof having added thereto from 10 to 10,000 ppm of an alkali metal or alkaline earth metal salt of ethylenediaminetetraacetic acid.

2. The mold release material of claim 1 wherein said fatty acid ester is at least one selected from the group consisting of animal oils and vegetable oils.

* * * * *